US007287360B2

(12) United States Patent
Makar et al.

(10) Patent No.: US 7,287,360 B2
(45) Date of Patent: Oct. 30, 2007

(54) BOTTOM TAPING SYSTEM USING A PUSHER FEED

(75) Inventors: Chris Peter Makar, Vancouver (CA); Peter Clive Sewell, Vancouver (CA)

(73) Assignee: Wexxar Packaging, Inc., Delta, British Columbia (CA)

( * ) Notice: Subject to any disclaimer, the term of this patent is extended or adjusted under 35 U.S.C. 154(b) by 63 days.

(21) Appl. No.: 10/981,455

(22) Filed: Nov. 5, 2004

(65) Prior Publication Data

US 2006/0096242 A1 May 11, 2006

(51) Int. Cl.
*B65B 51/06* (2006.01)
*B65B 61/00* (2006.01)

(52) U.S. Cl. ..... 53/136.1

(58) Field of Classification Search ..... 53/136.1, 53/376.7, 251, 448; 198/369.4, 346, 346.1
See application file for complete search history.

(56) References Cited

U.S. PATENT DOCUMENTS 4,291,518 A * 9/1981 Johnson ..... 53/491
4,553,954 A 11/1985 Sewell et al.
5,454,776 A 10/1995 Ulrich et al.

* cited by examiner

*Primary Examiner*—Rinaldi I. Rada
*Assistant Examiner*—John Paradiso
(74) *Attorney, Agent, or Firm*—Thompson Hine LLP

(57) ABSTRACT

A case forming machine is disclosed wherein a pusher engages a trailing panel of a case with its bottom flaps folded to closed position and provided the sole means for moving the case from the folding station through a bottom taping systems thereby eliminating the need for the conventional belt drive used to move the case through the taping station.

25 Claims, 3 Drawing Sheets

BOTTOM TAPING SYSTEM USING A PUSHER FEED

FIELD OF INVENTION

The present invention relates to a carton or case forming machine having a simplified case feeding for moving the case through a bottom taping station.

BACKGROUND OF THE PRESENT INVENTION

In the manufacture (erection and taping of flaps to produce a carton or case from a knocked down blank) the knocked down carton or case is first squared and then the bottom flaps folded into closed position and where a taping system is used the tape is applied to hold the folded bottom flaps in closed position. The squaring operation generally withdraws a singe knocked down case blank from a magazine of such blanks held in face to face position, opens the blank from the knocked down condition into a squared condition wherein adjacent side walls of the case are generally mutually perpendicular and positions the squared blank into a bottom flap folding station. In the bottom flap folding station the minor flaps (generally the shorter flaps) one connected to each of the leading and trailing side panels of the case oriented in the direction of travel of the case from the erecting station are folded relative to their respective side panels and then the major flaps one connected to each of the remaining side wall (walls parallel to the direction of travel) are folded into underlining relation (outwardly exposed relation) to the minor flaps. The so erected case is then moved into the taping station where a tape is applied along the bottom major flaps extending in the direction of travel of the case through the taping station to secure the major flaps in folded closed position and thereby the case in squared condition with the adjacent side panels mutually perpendicular. In this condition the top closing flaps are generally in open position so that the case may be filled and then the top flaps are closed and secured in closed position for example by taping similar to the bottom taping operation to complete the erecting filling and closing cycle and the filed box is ready for shipment.

In the taping station the case is held against the bottom taping head by some suitable hold down means which includes or may be provided primarily by the belt drive system the belts of which contact opposite major side walls of the case and move the case through the taping station where, the bottom tape is applied. It is known, as shown for example in U.S. Pat. No. 5,454,776 issued Oct. 3, 1995 to Ulrich et al., to use tilted rollers (rollers who's axis of rotation is sloped so that the circumference of the tilted roller generates a force on the case as the case is moved there past) to aid in holding the case against the bottom tape head U.S. Pat. No. 5,553,954 issued Nov. 10, 1985 to Sewell et al. and the said U.S. Pat. No. 5,454,776 issued Oct. 3, 1995 to Ulrich et al. (the disclosures of these patents are incorporated herein by reference) provide examples of the types of machines described above and for which the present invention provides an improved and less expensive system than the systems currently employed and that have been in use for years in that a single drive provides the required driving forces to move the case from the bottom flap folding station and through the bottom taping station.

The current systems process all cases by moving them forward in the direction of travel by applying generally a uniform force to both sides to the case so that no correction is available should the blanks tend to fold along their fold lines in a manner to result in some case leaving the erector having some horizontal curving or warping making packing on pallets more difficult.

BRIEF DESCRIPTION OF THE PRESENT INVENTION

It is the main object of the present invention to provide a simplified and less expensive drive system (relative to the combination belt drive and pusher system currently employed) for moving cases through a bottom taping station.

It is a further object of the present invention to provide an improved hold down system employing tilted rollers to act solely to hold the case against the bottom tape head Broadly the present invention relates to a case forming machine comprising a means to position a squared case into a bottom flap folding station wherein bottom flaps are folded each relative to its adjacent wall panel which include a leading wall panel and a trailing wall panel each in a plane substantially perpendicular to a direction of travel of said case from said bottom flap folding station and a pair of opposed side panels each in a plane substantially parallel to said direction of travel, said bottom flap folding station being positioned adjacent to a bottom tape applying station which has a bottom tape applying head to apply a tape to an opposed pair of said bottom flaps and a hold down means to hold the case in position against said bottom tape applying head as said tape is applied by said bottom tap applying head, a pusher mechanism, said pusher mechanism providing the sole means for moving said case in said direction from said bottom flap folding station through said tape applying station, said pusher mechanism comprising case engagement means contacting said trailing wall panel to apply forces to said case to push said case through said tape applying station and a drive means for moving said case engagement means and thereby said case through said tape applying station as said tape is being applied.

Preferably said hold down means is formed by a plurality of hold down rollers mounted on opposite sides of said bottom tape head and in position to engage side panels as said case is moved through said tape applying station, each of said hold down rollers having it axis of rotation oriented so that rotation of each said roller through friction with its adjacent side wall applies a downward force forcing its adjacent said side wall and thereby said bottom flaps toward said tape applying head to hold said case in tape applying position.

Preferably each of said hold down rollers is deformable and is positioned so that the area of contact between said roller and its adjacent said side wall is at least one inch long measured in said direction of travel.

Preferably said pusher drive comprises a reciprocating drive positioned adjacent to one side of said bottom flap folding and said tape applying stations for reciprocating back and forth parallel to said direction, means connecting said pusher means to said drive to move therewith and means for driving said reciprocating drive.

Preferably said reciprocating drive comprises a belt type drive and said pusher means is connected to a belt of said belt type drive.

Preferably said pusher drive comprises a pair of reciprocating drives positioned one on each side of said bottom flap folding and said tape applying stations for reciprocating back and forth parallel to said direction, said pusher means comprising a pair of finger pushers one connected to each of said reciprocating drives to move therewith, each of said pusher fingers being mounted for movement between a pushing position wherein said finger engages said trailing panel and pushes there against when said drive means moves said fingers in said direction to move said case through said tape applying station and a retracted position wherein said fingers are retracted when said fingers are moved backward relative to said direction and means for driving said reciprocating drive.

Preferably said pusher fingers are pivotably mounted on their respective reciprocating drive and are oriented and positioned to contact said leading side wall when moved in said backward relative to said direction and be pivoted out of the way.

Preferably each said reciprocating drive comprises a belt type drive and each of said pusher fingers is connected to a belt of its said belt type drive.

Preferably said means connecting said engagement means to said drive comprises an adjustable mounting at one side of said engagement means to orient said engagement means to a selected skewed.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figures 1, 2, 2A:
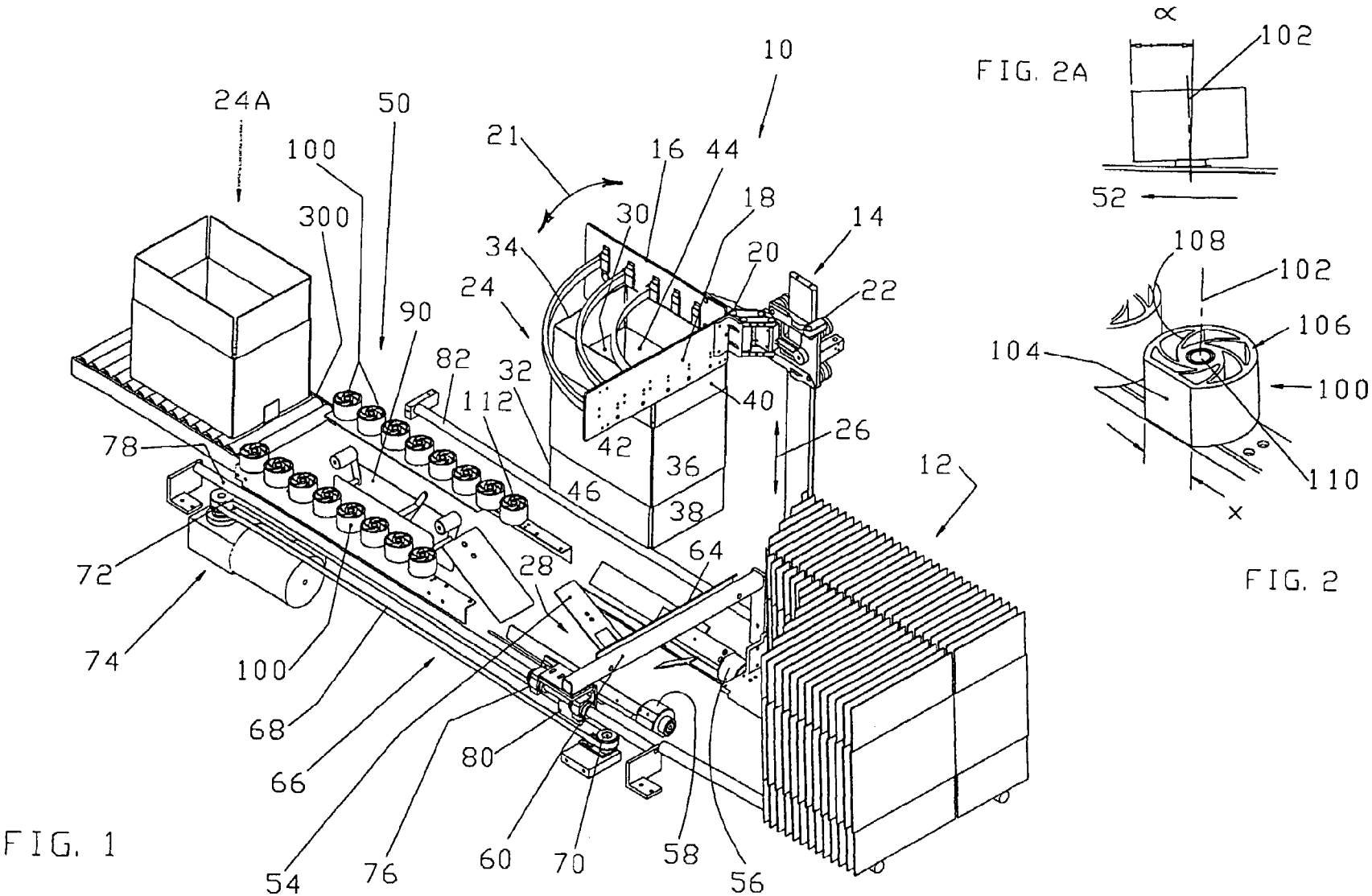
FIG. 1 is a schematic isometric illustration of a first embodiment of the present invention.
FIG. 2 is an illustration of the structure and mount of one of the tilted hold down rolls used in the present invention.
FIG. 2A shows the tilt angle $\alpha$ of the axis of rotation of the hold down rolls.

FIG. 1 illustrates a typical application of the present invention and particularly showing the invention applied to the erector of type described in U.S. Pat. No. 4,553,954 referred to above and incorporated herein by reference.

The erector and sealer 10 is provided with a magazine 12 containing knocked down box blanks which are extracted and squared by the mechanism 14 which include a moveable jaw 16 and a fixed jaw 18. The moveable jaw 16 is pivoted by a suitable drive as represented and indicated by arrow 21 on pivotal axis or hinge 20 between a gripping position wherein the jaws 16 and 18 are in opposed substantially parallel position and a squaring or open position wherein the jaws are substantially mutually perpendicular as shown. The fixed and moveable jaws 16 and 18 carrying an open or squared case 24 (squared by movement of the jaw 16 to the perpendicular or squaring position) are then moved vertically by the elevator mechanism schematically indicated at 22 as indicated by the arrow 26. The jaws in closed position (substantially parallel) receive a knocked down blank there between and engage and move same from the magazine as described in U.S. Pat. No. 4,553,954. The jaws 16 and 18 are then opened to the position illustrated i.e. at a right angle to each other, to square the case 24 which is then moved downward as indicated by the arrow 26 into the bottom flap folding station 28 (see U.S. Pat. No. 4,553,954 and related improvements forming the subject matter of other about to be applied for patents). The squared case 24 has a leading wall panel 30 (leading in the direction (see arrow 52) of movement of the case through the machine 10 from the bottom flap folding station 28 to and through the bottom tape applying station 50 as indicated by the arrow 52) to which are connected a leading bottom flap 32 and a leading top flap 34. The case 24 has a corresponding trailing wall 36 with corresponding trailing bottom 38 and top 40 trailing flaps. The leading and trailing wall panels 30 and 36 are interconnected by a pair of opposed side wall panels 42 and 44 each with their bottom and top flaps 46 and 48 (the bottom flap 46 connected to side wall 44 is not visible in the drawings). The shorter (leading and trailing flaps or sides are generally referred to as minor flaps or side walls and the longer walls 42 and 44 and their respective bottom and top flaps 46 and 48 are generally called the major side walls or flaps. Generally but not necessarily the major walls and flaps are oriented parallel to the direction of travel 52 which as will be apparent is the direction of tape application so the major flaps are folded last and are exposed as the case 24 is moved into the bottom sealing station 50 which is shown as a taping station 50 and the tape is applied to these flaps 46 (only one shown).

The folding station 28 is provided with conventional flap folding equipment including the leading flap folding arm 54 and a similar arm (not shown) for folding the trailing flap 38 fold these flaps 32 and 38 to positions substantially perpendicular to their respective leading and trailing wall panels 30 and 36 as the case 24 is moved down in the direction of the arrows 26. Next the major bottom flaps 46 are folded substantially perpendicular to their respective side wall panels 42 and 44 by the rotating folding cylinders 56 and 58 which rotate when the case has reached its lowered position in the station 28 and fold the flaps 46 as described.

The squared case 24 with its bottom flaps 32, 36 and 46 folded is then advanced into and through the bottom tape applying station 50 by the pusher mechanism 60. This pusher mechanism 60 includes a pusher bar 62 which in the FIG. 1 embodiment extends across the machine and is provided with a pusher plate 64 mounted on the bar 62. The pusher plate 64 contacts the trailing panel 36 of the squared case 24 and applies a force thereto to push the case 24 to and through the sealing station (tape applying station) 50 as will be described below.

The pusher bar 62 is connected to and driven by a reciprocating drive mechanism 66 which preferably is in the form of a belt type drive, but other reciprocated drive may be substituted if desired. The illustrated belt system 66 is formed by a circular or looped belt 68 mounted on pulleys 70 and 72 that rotate on parallel axes substantially perpendicular to the direction of travel 52 so that the main track of the belt 68 is parallel to the direction 52. One of the pulleys, in the illustrated version pulley 72 is driven by a suitable drive motor 74.

One end of the bar 62 is connected to a guide 76 that is slidably mounted on a rod 78 or the like the axis of which is parallel to the direction 52 to guide the movement of the bar 62 and the guide 76 is in turn connected to the belt 68 as indicated at 80 and is thereby driven by the drive 60.

The free end of the bar 62 is preferably connected to a second guide element 82 the movement of which is guided by guide rod 82 similar to the rod 78.

As above indicated the pusher bar 62 is moved in the direction 52 to push the case from the station 28 to and through the sealing station 50 and provides the sole means for so moving the cases.

The sealing station 50, in the illustrated version a tape applying station 50, is laid out essentially the same as previous such stations as described in the two US patents referred to above and is composed of a tape applying head 90 which preferably will be of the low pressure applying head type over which the case is pushed by pusher mechanism 60 and the tape applied in the conventional manner.

With the present invention employing the pusher system no drive belt is provided or required to move the case 24 through the taper and to hold the carton down against the tape head 90. The sole means for holding the case against the tape head in this embodiment is the rollers 100 a plurality of which are oriented or tilted with their axis of rotation in a plane parallel to the direction 52 but at angle $\alpha$ to the vertical so that rotation of the periphery of each of the rollers tends to move the case toward the tape head 90. An angle $\alpha$ of between 1 and 4 degrees has been found to be effective. Obviously the greater the angle $\alpha$ the greater the vertical force component tending to hold the case 24 against the tape head 90.

The pressure between the rollers 100 and the adjacent side wall of the case 24 flattens the side of the roller 100 as indicated 104 contacting the side wall of the case. Preferably for hollow rollers 100 made of soft poly urethane sleeves 106 connected by curved vanes 108 to the central axel 110 of roll 100 the length X of the flattened portion 104 (cord) measured parallel to the direction 52 will be at least about 1 inch and is determined by how close the rolls are positioned to the normal path of the side walls.

In the illustrated arrangement the first 2 rollers 112 are the same as the above described rollers 100 but are not tilted at angle $\alpha$ but preferably are substantially vertical.

Figure 3:
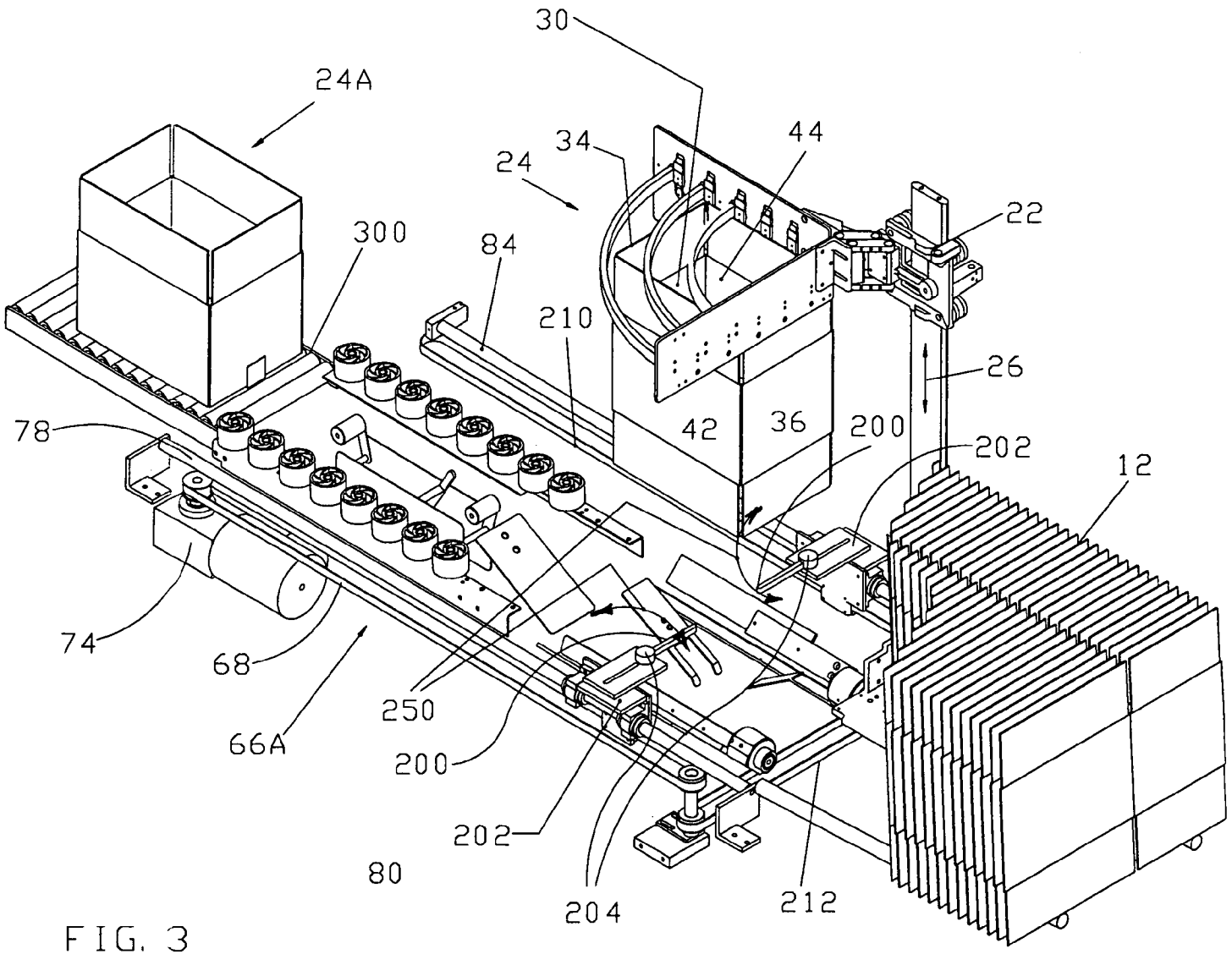
FIG. 3 is a view similar to FIG. 1 but shown a faster pusher operating system to permit an increase output from the machine.

Turning now to FIG. 3 which is basically the same as the FIG. 1 embodiment-like parts have been indicated with like numbers and some parts have been omitted. The major difference between the FIGS. 3 and 1 embodiments is the pusher mechanism 60A of FIG. 3 is different from the mechanism 60 of FIG. 1 and this difference required the use of a different drive system 66A.

In effect the pusher bar 62 and the plate 64 of FIG. 2 have been replaced by a pair of essentially mirror image pusher fingers indicated at 200 there being one on each side of the machine 10A. Each of the pusher fingers 200 is mounted on its respective base 202 to pivot on a substantially vertical pivot pin 204. A suitable spring or the like (not shown) urges the finger 200 to the position shown with the finger 200 resting against a stop (not shown) and extending substantially parallel to the trailing panel 36 (i.e. substantially perpendicular to the direction 52) in the bottom flap folding station 28 so that each finger 200 may engage the panel 36 at opposite sides thereof i.e. adjacent panels 42 and 44 and push the case 24 from the folding station 28 and through the sealing (tape applying) station 50 in the same manner as the pusher plate 64 when driven in the direction 52.

The drive 66A is duplicated at the opposite side of the machine as indicated schematically at 210 with the belt 212 interconnecting the two reciprocating drives which are shown as belt drives so that both of the platforms 202 which are connected to the drive belts 68 via their respective guide 76 (there being a second such belt at the side of the machine adjacent to the guide rod 84) are moved at the same speed and in the same direction.

In operation both systems are provided with the conventional required sensors and controls to operate so that the drive 66 or 66A to move the pusher 60 or 60A from the starting position shown in FIGS. 1 and 3 to a position where the case has been moved out the side of station 50 remote from the station 28 and is on the off-going table 300 as indicated by the case 24A which has its bottom closed and sealed (taped) and is ready to be filled. The pusher 60 or 60A is then retracted to the starting position illustrated.

In the FIG. 1 embodiment the pusher 60 must be fully retracted to the starting position before the next squared case 24 is lowered into the bottom flap folding station 28, whereas with the FIG. 3 embodiment the operation speed may be increase since the squared case 24 may be in position when the pusher 60A is moving the backward i.e. opposite direction to direction 52 as the fingers will simply contact the leading side wall or panel 30 of the case and be deflected as indicated by the arrows 250 to a position at about 90 degrees to the illustrated position so they may pass by the sides of the case i.e. rub on the side walls 42 and 44 and then when the fingers 200 clear the case 24 i.e. rear panel 36 the springs will move them back to the operative position as shown in FIG. 3.

Figure 4:
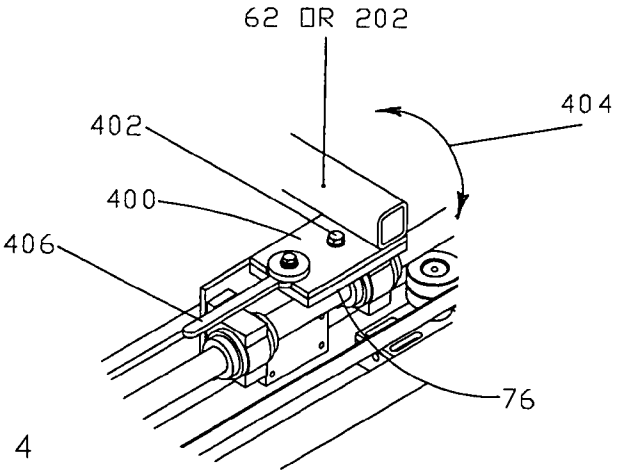
FIG. 4 is a partial view showing an adjustable mounting of one side of the pusher to permit better squaring of some case blanks to form erected cases.

Turning now to FIG. 4 provision has been made to adjust the angle of the pusher bar 62 or the relative positions of the two fingers 200 to reduce curving or warping in the set-up case. This is accomplished by providing a mounting plate 400 pivotable mounted on the guide 76 which is connected to the drive belt 68 no onto which is mounted the end of the pusher bar 62 or the finger platform 202 depending on which embodiment is being used. The mounting plate is pivotable mounted for movement about the pin 402 as indicated by the arrow 404. Such pivotal movement may be achieved by any suitable means a simple lever 406 with an eccentric cam connection to plate 400 has been shown for this purpose in FIG. 4.

Pivoting of the lever 406 causes the mounting plate 400 to pivot about pin 402 which reorients the driven end of the bar 62 which is fixed to the plate 400 when used in the FIG. 1 embodiment so that it is oriented at a skew angle $\beta$ from the direction 52 that is selected to be that required to complete the squaring of the case (if necessary) as it is pushed by the (angled) bar 62 against the resistance of the rollers 100 (and 112). i.e. the skew plane of contact 410 is at a selected angle $\beta$ which will normally be in the range of 85 to 95 degrees. The end of the bar 62 farthest advance will develop forces on its side of the partially set up case before the pressure is applied to the opposite side and thus the angle $\beta$ is selected to thereby correct for a consistent tendency for the case to be skewed when the bar is perpendicular to the direction 52. Obviously if the case sets up square with the angle $\beta$ 90 degrees no adjustment will be required.

Figure 5:
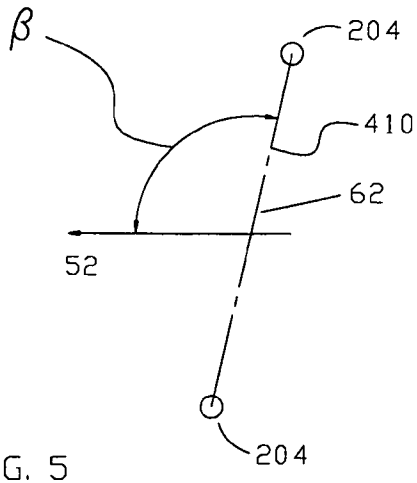
FIG. 5 is a schematic illustration of the skew angle for better squaring of case blanks to form erected cases.

When the mechanism of FIG. 4 is applied to the FIG. 3 embodiment pivoting of the lever 406 causes the mounting plate 400 to pivot about pin 402 which reorients the platform 202 that is fixed thereto and thereby repositions the finger 200 so that its pivot point 204 is no longer positioned in a plane at a right angle to the direction 52 and passing through the pin 204 of the finer 200 on the opposite side of the machine i.e. a skew plane 410 (see FIG. 5) passing through the pins 204 on opposite sides of the machine is oriented at a skew angle $\beta$ that is selected to be that required to complete the squaring of the case (if required) as it is pushed by the against the resistance of the rollers 100 (and 112). The pin 204 farthest advance in the direction 52 will develop forces on its side of the partially set up case before the rear pin 204 on the opposite side of the case and thus thereby correct for a consistent tendency for the case to be skewed. If no correction is required obviously the plane 410 will be normal to the direction 52.

Having described the invention, modifications will be evident to those skilled in the art without departing from the scope of the invention as defined in the appended claims.

We claim:

1. A case forming machine comprising a bottom flap folding station wherein bottom flaps are folded each relative to its adjacent wall panel, including a first bottom flap adjacent a leading wall panel and a second bottom flap adjacent a trailing wall panel relative to a direction of travel from said bottom flap folding station to and through a bottom tape applying station, and third and fourth bottom flaps each adjacent a respective one of a pair of opposed side wall panels each in a plane substantially parallel to the direction of travel, said bottom flap folding station being positioned upstream of said bottom tape applying station which has a bottom tape applying head, a pusher mechanism comprising one or more trailing wall panel pushers arranged to contact the trailing wall panel, said one or more trailing wall panel pushers moveable from said bottom flap folding station to and through said bottom tape applying station past said bottom tape applying head such that said one or more trailing wall panel pushers move the case from said bottom flap folding station through said bottom tape applying station so that such movement occurs without application of any forward driving contact to the opposed side wall panels, a drive operatively connected for moving said one or more trailing wall panel pushers and thereby the case through said bottom tape applying station as tape is being supplied.

2. The case forming machine of claim 1 wherein a plurality of tollers are located on opposite sides of said bottom tape applying head and in position to engage the opposed side wail panels of the case for holding the case in tape applying position as the case is moved through said bottom tape applying station.

3. The case forming machine of claim 1 wherein said one or more trailing wall panel pushers comprises first and second pusher fingers located toward opposite sides of a path of case travel.

4. The case forming machine of claim 3 wherein said first and second pusher fingers are each pivotable about a respective axis.

5. The case forming machine of claim 3 wherein said drive comprises a belt-type drive having a belt located to one side of a path of travel of the case, said belt positioned to avoid contact with the case traveling along the path, the one or more trailing wall pushers including at least one trailing wall pusher linked for movement with said belt.

6. A case forming machine comprising a means to position a squared case into bottom flap folding station wherein bottom flaps are folded each relative to its adjacent wall panel which include a leading wall panel and a trailing wall panel relative to a direction of travel of said case from said bottom flap folding station and a pair of opposed side panels each in a plane substantially parallel to said direction of travel, said bottom flap folding station being positioned adjacent to a bottom tape applying station which has a bottom tape applying head to apply a tape to an opposed pair of said bottom flaps and a hold down means to hold the case in position against said bottom tape applying head as said tape is applied by said bottom tape applying head, a pusher mechanism, said pusher mechanism providing the sole means that contacts said case to move said case in said direction from said bottom flap folding station through said bottom tape applying station and to a position in which said trailing wall panel is located beyond said bottom tape applying head, said pusher mechanism comprising case engagement means contacting said trailing wall panel to apply forces to said case to push said case through said bottom tape applying station, a drive means and means connecting said drive means to said case engagement means for moving said case engagement means and thereby said case through said bottom tape applying station as said tape is being applied.

7. A case forming machine as defined in claim 1 wherein said hold down means is formed by a plurality of hold down rollers mounted on opposite sides of said bottom tape applying head and in position to engage side panels as said case is moved through said bottom tape applying station, each of said hold down rollers having it axis of rotation oriented so that rotation of each said roller through friction with its adjacent side wall applies a downward force forcing its adjacent said side wall and thereby said bottom flaps toward said bottom tape applying head to hold said case in tape applying position.

8. A case forming machine as defined in claim 7 wherein each of said hold down rollers is deformable and is positioned so that the area of contact between said roller and its adjacent said side wall is at least one inch long measured in said direction of travel.

9. A case forming machine as defined in claim 8 wherein said pusher drive comprises a reciprocating drive positioned adjacent to one side of said bottom flap folding and said bottom tape applying stations for reciprocal moving back and forth the parallel to said direction, said pusher means connected to said drive to move therewith and means for driving said reciprocating drive.

10. A case forming machine as defined in claim 9 wherein said reciprocating drive comprises a belt type drive and said pusher means is connected to a belt of said belt type drive.

11. A case forming machine as defined in claim 8 wherein said pusher drive comprises a pair of reciprocating drives positioned one on each side of said bottom flap folding and said bottom tape applying stations for moving back and forth parallel to said direction, said engagement means comprising a pair of finger pushers one connected to each of said reciprocating drives to move therewith, each of said pusher fingers being mounted for movement between an operative pushing position wherein said finger engages said trailing wall panel and pushes there against when said drive means moves said fingers in said direction to move said case through said bottom tape applying station and a retracted position wherein said fingers are retracted when said fingers are moved in a backward direction opposite to said direction and means for driving said reciprocating drive.

12. A case forming machine as defined in claim 11 wherein said pusher fingers are pivotably mounted on their respective reciprocating drive and are oriented and positioned to contact a lending wall panel of a next case at said bottom flap folding station when moved backward relative to said direction and be pivoted into said retracted position.

13. A case forming machine as defined in claim 12 wherein each said reciprocating drive comprises a pair of interconnected belt type drives and each of said pusher fingers is connected to a belt of its said belt type drive.

14. A case forming machine as defined in claim 7 wherein said pusher drive comprises a reciprocating drive positioned adjacent to one side of said bottom flap folding and said bottom tape applying stations for reciprocal moving back and forth the parallel to said direction, said pusher means connected to said drive to move therewith and means for driving said reciprocating drive.

15. A case forming machine as defined in claim 14 wherein said reciprocating drive comprises a belt type drive and said pusher means is connected to a belt of said belt type drive.

16. A case forming machine as defined in claim 7 wherein said pusher drive comprises a pair of reciprocating drives positioned one on each side of said bottom flap folding and said bottom tape applying stations for moving in back and for the parallel to said direction, said engagement means comprising a pair of finger pushers one connected to each of said reciprocating drives to move therewith, each of said pusher fingers being mounted for movement between an operative pushing position wherein said finger engages said trailing wall panel and pushes there against when said drive means moves said fingers in said direction to move said case through said tape applying station and a retracted position wherein said fingers are retracted when said fingers are moved in a backward direction opposite to said direction and means for driving said reciprocating drive.

17. A case forming machine defined in claim 16 wherein said pusher fingers are pivotably mounted on their respective reciprocating drive and are oriented and positioned to contact a leading wall panel of a next case at said bottom flap folding station when moved backward relative to said direction and be pivoted out of the way.

18. A case forming machine as defined in claim 17 wherein each said reciprocating drive comprises a pair of interconnected belt type drives and each of said pusher fingers is connected to a belt of its said belt type drive.

19. A case forming machine as defined in claim 1 wherein said pusher drive comprises a reciprocating drive positioned adjacent to one side of said bottom flap folding and said bottom tape applying stations for reciprocal moving back and forth parallel to said direction, said pusher means connected to said drive to move therewith and means for driving said reciprocating drive.

20. A case forming machine as defined in claim 19 wherein said reciprocating drive comprises a belt type drive and said pusher means is connected to a belt of said belt type drive.

21. A case forming machine as defined in claim 1 wherein said pusher drive comprises a pair of reciprocating drives positioned one on each side of said bottom flap folding and said bottom tape applying stations for reciprocating back and forth parallel to said direction, said engagement means comprising a pair of finger pushers one connected to each of said reciprocating drives to move therewith, each of said pusher fingers being mounted for movement between an operative pushing position wherein said finger engages said trailing wall panel and pushes there against when said drive means moves said fingers in said direction to move said case through said bottom tape applying station and a retracted position wherein said fingers are retracted when said fingers are moved in a backward direction opposite to said direction and means for driving said reciprocating drive.

22. A case forming machine as defined in claim 21 wherein said pusher fingers are pivotably mounted on their respective reciprocating drive and are oriented and positioned to contact a leading wall panel of a next case at said bottom flap folding station when moved backward relative to said direction and be pivoted.

23. A case forming machine as defined in claim 22 wherein each said reciprocating drive comprises a pair of interconnected belt type drives and each of said pusher fingers is connected to a belt of its said belt type drive.

24. A case forming machine as defined in claim 21 wherein said means connecting said engagement means to said drive comprises an adjustable mounting at one side of said pusher mechanism to orient said engagement means to contact said case on a plane at a selected skew to said direction.

25. A case forming machine as defined in claim 1 wherein said means connecting said engagement means to said drive comprises an adjustable mounting at one side of said pusher mechanism to orient said engagement means to contact said case on a plane at a selected skew to said direction.

* * * * *

UNITED STATES PATENT AND TRADEMARK OFFICE

CERTIFICATE OF CORRECTION

PATENT NO. : 7,287,360 B2
APPLICATION NO. : 10/981455
DATED : October 30, 2007
INVENTOR(S) : Chris Peter Makar et al.

It is certified that error appears in the above-identified patent and that said Letters Patent is hereby corrected as shown below:

Column 7

Line 36, change “tollers” to -- rollers --.

Line 38, change “wail” to -- wall --.

Line 55, after “into” insert -- a --.

Column 8

Line 13, change “1” to -- 6 -- after the word claim.

Line 18, change “it” to -- its --.

Line 33, after the word forth, delete “the”.

Line 57, change “lending” to -- leading --.

Column 9

Line 1, after the word forth, delete “the”.

Line 11, after the word moving, delete “in”.

Line 12, change “for” to -- forth --; and delete “the” before parallel.

Line 33, change “1” to -- 6 --.

UNITED STATES PATENT AND TRADEMARK OFFICE

CERTIFICATE OF CORRECTION

PATENT NO. : 7,287,360 B2
APPLICATION NO. : 10/981455
DATED : October 30, 2007
INVENTOR(S) : Chris Peter Makar et al.

It is certified that error appears in the above-identified patent and that said Letters Patent is hereby corrected as shown below:

Column 10

Line 1, change "1" to -- 6 --.

Line 36, "1" to -- 6 --.

Signed and Sealed this

Twenty-fifth Day of March, 2008

JON W. DUDAS
*Director of the United States Patent and Trademark Office*